US005300476A

United States Patent [19]

Kubodera et al.

[11] Patent Number: 5,300,476

[45] Date of Patent: Apr. 5, 1994

[54] THERMAL TRANSFER RECORDING MATERIAL

[75] Inventors: Seiiti Kubodera; Mitsugu Tanaka; Tetsu Kamosaki, all of Kanagawa, Japan

[73] Assignee: Fuji Photo Film Co., Ltd., Kanagawa, Japan

[21] Appl. No.: 960,871

[22] Filed: Oct. 14, 1992

[30] Foreign Application Priority Data

Oct. 17, 1991 [JP] Japan ..... 3-296624
Mar. 27, 1992 [JP] Japan ..... 4-100217

[51] Int. Cl.[5] ..... B41M 5/035; B41M 5/38

[52] U.S. Cl. ..... 503/227; 428/195; 428/447; 428/913; 428/914

[58] Field of Search ..... 8/471; 428/195, 447, 428/913, 914, 341, 336, 419, 423.1, 474.4, 480, 500, 522; 503/227

[56] References Cited

U.S. PATENT DOCUMENTS 4,626.256 12/1986 Kawasaki et al. ..... 8/471
4.738,950 4/1988 Vanier et al. ..... 503/227
4,774,224 9/1988 Campbell ..... 503/227
4,820,687 4/1989 Kawasaki et al. ..... 503/227
4,927,666 5/1990 Kawasaki et al. ..... 427/146
4,968,659 11/1990 Nishitani ..... 503/227
4,990,485 2/1991 Egashira et al. ..... 503/227
5,070,068 12/1991 Nishitani ..... 503/227

*Primary Examiner*—B. Hamilton Hess
*Attorney, Agent, or Firm*—Sughrue, Mion, Zinn, Macpeak & Seas

[57] ABSTRACT

A thermal transfer recording material composed of a dye-providing element having a dye-providing layer containing a thermal transferring dye and a binder resin as provided on a support and an image-receiving element having a dye-receiving layer containing a dye-receiving high polymer compound, in the main, as provided on a support, the dye-providing layer and the dye-receiving layer being kept in contact with each other and heatable in accordance with image signals so as to transfer the dye from the dye-providing layer to the dye-receiving layer to attain recording, in which the surface(s) of the dye-providing layer and/or the dye-receiving layer contain(s) at least one modified polysiloxane compound of formula (1).

12 Claims, No Drawings

THERMAL TRANSFER RECORDING MATERIAL

FIELD OF THE INVENTION

The present invention relates to a thermal transfer recording material and, more precisely, to a thermal transfer recording material composed of a dye-providing element and an image-receiving element.

BACKGROUND OF THE INVENTION

Recently, a thermal transfer system has been developed in which prints can be obtained from images electronically formed with a color video camera. According to one method of obtaining such prints, an electronic image is first subjected to color separation with a color filter. Then, the respective color-separated pixels are converted into electric signals. Subsequently, these signals are processed to provide yellow, magenta and cyan electric signals. Next, these signals are transmitted to a thermal printer. For obtaining prints, an yellow, magenta or cyan dye-providing element is attached to a color image-receiving element with the surfaces of the two facing to each other. Subsequently, the two elements are inserted between a thermal head and a platen roller. Using a line-type thermal head, the two elements are heated from the back surface of the dye-providing element. The thermal head has many heating means so that the dye-providing element is successively heated in response to the yellow, magenta and cyan signals therein. Subsequently, the step is repeated for the other two remaining colors. Accordingly, a color hard copy corresponding to the original image as seen on the screen is obtained.

Another method of thermally obtaining prints with the above-mentioned electric signals is a method using a laser in place of the thermal head. A dye-providing element to be used in the laser system contains a material which strongly absorbs laser rays applied thereto. Where laser rays are irradiated upon such a dye-providing element, the absorbing material acts to convert the light energy to heat energy, whereupon the heat is transmitted to the nearest dye, and the dye is then heated up to the thermal transferring temperature so as to be transferred to the adjacent image-receiving element. The absorbing material exists as a layer beneath the transferring dye and/or is blended with the dye. The irradiating laser beams are modulated by the electric signals to express the shape and the color of the original image. As a result, only the dyes within the irradiated areas on the dye-providing element are heated and thermally transferred.

As mentioned above, direct contact of a dye-providing element to an image-receiving element is indispensable in a thermal transfer recording system, and, after recording, the two elements must be peeled off from each other.

However, these methods were not without their problems. For example, during the peeling step, the elements are statically charged and, as a result, dust adheres to them so that the recorded surface is undesirably stained. Also, where recorded image-receiving elements are stacked up, they would attach to each other due to static electricity and heat so that they could not be separated from each other. As the case may be, the dye providing layer would peel off to adhere to the image-receiving element. Thus, the statically charged dye-providing element would often be wrinkled. Additionally, discharge of the accumulated static charges would have an adverse effect on the electric system of recording apparatus. These problems prevent implementation of the thermal transfer recording system described above. In addition, these problems often diminish the quality of the recorded images.

The invention as disclosed in JP-A-61-199997 (the term "JP-A" as used herein means an "unexamined published Japanese patent application") is one attempt to solve these problems, but is not satisfactory.

SUMMARY OF THE INVENTION

Under this situation, the present inventors have variously investigated the above problems and have been able to solve them by the present invention described below.

Specifically, for solving the afore-mentioned problems, the present invention provides a thermal transfer recording material comprising a dye-providing element comprising a support having a dye-providing layer thereon containing a thermal transferring dye and a binder resin, and an image-receiving element comprising a support having thereon a dye-receiving layer containing a dye-receiving high polymer compound. The dye-providing layer and the dye-receiving layer are kept in contact with each other and heatable in accordance with image signals so as to transfer the dye from the dye-providing layer to the dye-receiving layer to attain recording. At least one of the dye-providing layer and the dye-receiving layer, at least in the surface(s), contain(s) at least one polysiloxane compound of the following general formula (1):

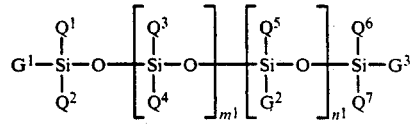

1 where $Q^1$ to $Q^7$ each represents an alkyl group, an alkoxy group or an aryl group;

$G^1$ to $G^3$ each represents $—Y^1—Y^2$, $—Y^3—NR—Y^4—N(R^0)—Y^5$, an alkyl group, an aryl group or an alkoxy group:

$Y^1$ represents an alkylene group, an arylene group or an aralkylene group;

$Y^2$ represents $—Z^1—Z^2$ or $—CO—Z^3$;

$Z^1$ represents $—NR^x—$ (where $R^x$ is a hydrogen atom or an alkyl group), —S— or —O—;

$Z^2$ represents $—CO—R^1$, $—CS—R^2$, $—SO_2—R^3$, or $—CR^4(R^5)R^6$;

$Z^3$ represents $—NR^7(R^8)$, $—OR^9$ or $—SR^{10}$;

$Y^3$ and $Y^4$ each has the same meaning as $Y^1$;

$Y^5$ has the same meaning as $Z^2$;

$R^0$ represents a hydrogen atom or an alkyl group;

R represents a hydrogen atom, an alkyl group or $Y^5$;

$R^1$, $R^2$ and $R^3$ each represents an alkyl group, an aryl group, an alkoxy group, an aryloxy group, an alkylamino group or an arylamino group;

$R^4$, $R^5$, $R^6$, $R^7$ and $R^8$ each represents a hydrogen atom, an alkyl group or an aryl group;

$R^9$ and $R^{10}$ each represents an alkyl group or an aryl group;

provided that at least one of $G^1$, $G^2$ and $G^3$ must be $—Y^1—Y^2$ or $—Y^3—NR—Y^4—N(R^0)—Y^5$; and $m^1$ represents an integer of from 0 to 1000, and $n^1$ represents an integer of from 1 to 1000.

Coefficients in parentheses are branch groups.

DETAILED DESCRIPTION OF THE INVENTION

The present invention will be explained in detail hereunder.

In formula (1), $Q^1$ to $Q^7$ each represents an alkyl group having from 1 to 10 carbon atoms (e.g., methyl, ethyl, butyl; preferably methyl), an alkoxy group having from 1 to 10 carbon atoms (e.g., methoxy, ethoxy, butoxy; preferably methoxy), or an aryl group having from 6 to 15 carbon atoms (e.g., phenyl, p-methylphenyl). Of $Q^1$, $Q^2$, $Q^6$ and $Q^7$, preferred is a methyl or methoxy group. Of $Q^3$ to $Q^5$, preferred is a methyl group. $Y^1$ represents an alkylene group having from 1 to 10 carbon atoms (e.g., $—CH_2—CH_2—$, $—CH_2CH(CH_3)—$, $—CH_2CH_2CH_2—$, $—CH_2CH(CH_3)CH_2—$, $—(CH_2)_6—$), an arylene group having from 6 to 15 carbon atoms (e.g., $—C_6H_4—$), or an aralkylene group having from 7 to 16 carbon atoms (e.g., $—CH_2C_6H_4—$, $—CH_2C_6H_4CH_2—$). For $Y^1$, preferred is an alkylene group having from 2 to 5 carbon atoms. $Z^1$ represents $—NR^x—$ (where $R^x$ is a hydrogen atom or an alkyl group having from 1 to 10 carbon atoms, such as methyl or ethyl), or —S— or —O—. For $R^x$, preferred is a hydrogen atom. For $Z^1$, preferred is —NH—. $Z^2$ represents $—COR^1$ [where $R^1$ is an unsubstituted or substituted alkyl group having from 1 to 20 carbon atoms (e.g., methyl, ethyl, propyl, isopropyl, t-butyl, chloromethyl, trifluoromethyl, octyl, phenoxypropyl; preferably methyl), an unsubstituted or substituted aryl group having from 6 to 25 carbon atoms (e.g., phenyl, p-methylphenyl, m-chlorophenyl, hexafluorophenyl; preferably phenyl), a heteryl group having from 3 to 20 carbon atoms (preferably 5-membered or 6-membered hetero group having at least one nitrogen, sulfur or oxygen atom; for example, 2-furyl, 2-tetrahydrofuryl, 3-pyridyl, 4-pyridyl, 2-thienyl), an alkoxy group having from 1 to 10 carbon atoms (e.g., methoxy, ethoxy, propoxy, octoxy; preferably methoxy, ethoxy), an aryloxy group having from 6 to 15 carbon atoms (e.g., phenoxy), an alkylamino group having from 1 to 10 carbon atoms (e.g., methylamino, ethylamino, dimethylamino, diethylamino), or an arylamino group having from 6 to 15 carbon atoms (e.g., phenylamino)], or $—CS—R^2$ (where $R^2$ has the same meaning as $R^1$), $—SO_2—R^3$ (where $R^3$ has the same meaning as $R^1$), or $—CR^4(R^5)R^6$ (where $R^4$, $R^5$ and $R^6$ each is a hydrogen atom, an alkyl group having from 1 to 10 carbon atoms such as methyl or ethyl, or an aryl group having from 6 to 15 carbon atoms such as phenyl; preferably a hydrogen atom). $Z^3$ represents $—NR^7(R^8)$ (where $R^7$ and $R^8$ each is a hydrogen atom, an alkyl group having from 1 to 10 carbon atoms such as methyl or ethyl, or an aryl group having from 6 to 15 carbon atoms such as phenyl), $—OR^9$ (where $R^9$ is an alkyl group having from 1 to 10 carbon atoms such as methyl or ethyl, or an aryl group having from 6 to 15 carbon atoms such as phenyl; preferably an alkyl group having from 1 to 4 carbon atoms), or $—SR^{10}$ (where $R^{10}$ has the same meaning as $R^9$). $Y^3$ and $Y^4$ each has the same meaning as $Y^1$. Preferred examples of $Y^3$ and $Y^4$ are the same as those mentioned for $Y^1$. $Y^5$ has the same meaning as $Z^2$, and preferred examples are the same as those for $Z^2$. $R^0$ represents a hydrogen atom or an alkyl group having from 1 to 10 carbon atoms such as methyl or ethyl. For $R^0$, preferred is a hydrogen atom. R represents a hydrogen atom, an alkyl group having from 1 to 10 carbon atoms (e.g., methyl, ethyl), or $Y^5$, preferably a hydrogen atom or $Y^5$. $Y^5$ has the same meaning as $Z^2$, and preferred examples are the same as those for $Z^2$.

The alkyl group represented by $G^1$ to $G^3$ has from 1 to 10 carbon atoms and, for example, it can be methyl, ethyl or butyl. The aryl group represented by $G^1$ to $G^3$ has from 6 to 15 carbon atoms and, for example, it can be phenyl. The alkoxy group represented by $G^1$ to $G^3$ has from 1 to 10 carbon atoms and, for example, it can be methoxy, ethoxy or butoxy. Of the alkyl, aryl or alkoxy group represented by $G^1$ or $G^3$, preferred is a methyl or methoxy group. Of the alkyl, aryl or alkoxy group represented by $G^2$, preferred is a methyl group. $m^1$ is preferably an integer of from 0 to 200; and $n^1$ is preferably an integer of from 1 to 100.

The at least one polysiloxane compound of formula (1) is preferably present in at least one of the dye-providing layer and the dye-receiving layer in an amount of from 0.01 to 2 $g/m^2$, more preferably from 0.01 to 0.5 $g/m^2$, and most preferably from 0.05 to 0.5 $g/m^2$.

Of the compounds of formula (1), especially preferred are those of formula (2):

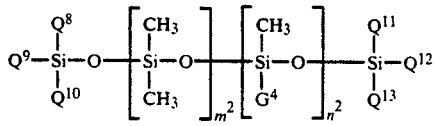

(2)

where $Q^8$ to $Q^{13}$ each represents a methyl group or a methoxy group;

$G^4$ represents $—Y^6—NH—CO—R^{11}$, or $—Y^7—N(R^{12})—Y^8—CO—R^{13}$;

$Y^6$, $Y^7$ and $Y^8$ each represents an alkylene group (having from 2 to 5 carbon atoms, such as $—CH_2—CH_2—$, $—CH_2—CH(CH_3)—$, $—CH_2CH_2CH_2—$, $—CH_2CH(CH_3)CH_2—$);

$R^{11}$ and $R^{13}$ each has the same meaning as $R^1$, and preferably are selected from an alkyl group (having from 1 to 5 carbon atoms, such as methyl, ethyl, isopropyl, t-butyl) or a phenyl group;

$R^{12}$ represents a hydrogen atom or $—COR^{14}$;

$R^{14}$ has the same meaning as $R^{11}$ (preferred examples of $R^{14}$ are also the same as those of $R^{11}$); and $m^2$ represents an integer of from 10 to 100, and $n^2$ represents an integer of from 1 to 100.

$m^2+n^2$ is from 11 to 200, preferably from 11 to 150. $n^2/m^2$ is within the range of from 1/100 to ⅓, preferably from 1/100 to 1/10.

Next, the structure and materials of the thermal transfer recording material of the present invention will be explained more concretely hereunder.

The support of the thermal transfer dye-providing element of the material may be any conventional one. For instance, it can be polyethylene terephthalate, polyamide, polycarbonate, glassine paper, condenser paper, cellulose ester, fluorine polymer, polyether, polyacetal, polyolefin, polyimide, polyphenylene sulfide, polypropylene, polysulfone, and cellophane.

The thickness of the support of the thermal transfer dye-providing element is generally from 2 to 30 μm. If desired, a subbing layer may be coated on it.

The thermal transfer dye-providing element has a thermal transferring dye. Basically, the dye-providing element has a dye-providing layer containing a dye being movable due to heat and a binder on the support.

For preparing the thermal transfer dye-providing element, a conventional dye, which is sublimable or movable due to heat and a binder resin, is dissolved or dispersed in a suitable solvent to form a coating liquid, and the liquid is coated on one surface of a conventional support for a thermal transfer dye-providing element in an amount to give a dry thickness of approximately from 0.2 to 5 μm, preferably from 0.4 to 2 μm and dried to form a dye-providing layer on the support.

The dye-providing layer may be a single layer or may also be composed of two or more layers for the purpose of using the element repeatedly many times. In the latter case, the content of the dye and the ratio of dye/binder in each constitutive layer may differ from one another.

Any conventional dye as heretofore been used in conventional thermal transfer dye-providing elements may be used in the thermal transfer dye-providing element of the present invention. Especially preferred for use in the present invention are those having a small molecular weight of approximately from 150 to 800, and they are selected in consideration of the transferring temperature, hue, light fastness, and solubility or dispersibility in ink and binder resin.

For instance, examples include disperse dyes, basic dyes and oil-soluble dyes, and preferred are Sumikaron Yellow E4GL, Dianix Yellow H2G-FS, Miketon Polyester Yellow 3GSL, Kayazet Yellow 937, Sumikaron Red EFBL, Dianix Red ACE, Miketon Polyester Red FB, Kayazet Red 126, Miketon Fast Brilliant Blue B and Kayazet Blue 136.

Yellow dyes of the following general formula (Y) are preferably used.

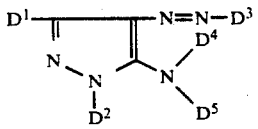

(Y)

where $D^1$ represents a hydrogen atom, an alkyl group, an alkoxy group, an aryl group, an alkoxycarbonyl group, a cyano group or a carbamoyl group; $D^2$ represents a hydrogen atom, an alkyl group or an aryl group; $D^3$ represents an aryl group or a heteryl group; $D^4$ and $D^5$ each represents a hydrogen atom or an alkyl group. These groups may optionally be substituted.

Specific examples of the yellow dyes are mentioned below.

Y-1

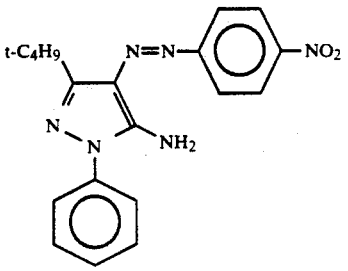

-continued

Y-2

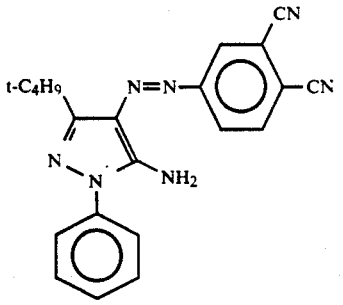

Y-3

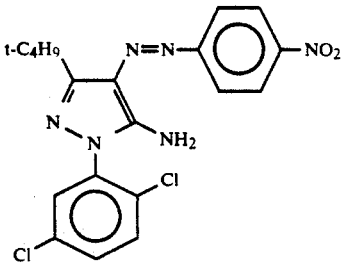

Y-4

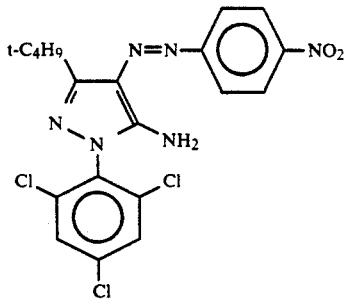

Y-5

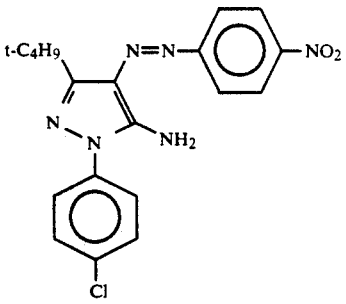

Y-6

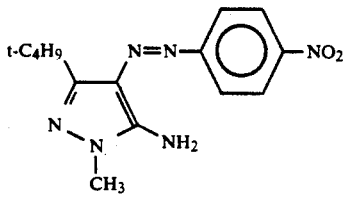

Y-7

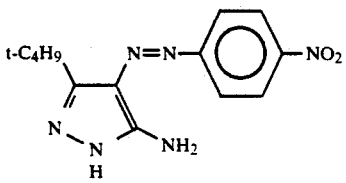

-continued

Y-8

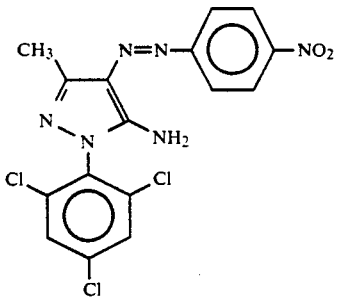

Y-9

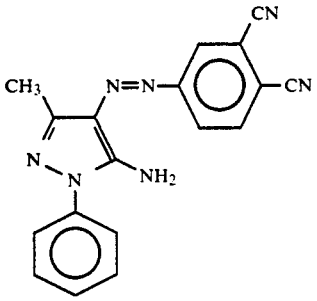

Y-10

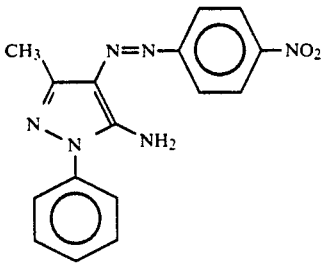

Y-11

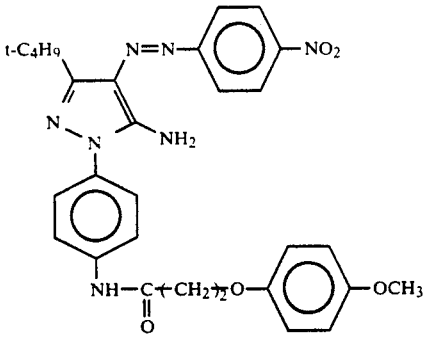

As magenta dyes for use in the present invention, preferred are those of the following general formula (M):

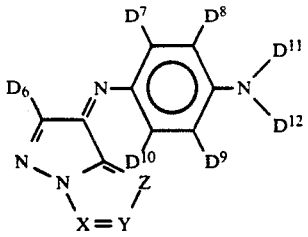

(M)

where $D^6$ to $D^{10}$ each represents a hydrogen atom, a halogen atom, an akyl group, an alkoxy group, an aryl group, an aryloxy group, a cyano group, an acylamino group, a sulfonylamino group, an ureido group, an alkoxycarbonyl amino group, an alkylthio group, an arylthio group, an alkoxycarbonyl group, a carbamoyl group, a sulfamoyl group, a sulfonyl group, an acyl group or an amino group;

$D^{11}$ and $D^{12}$ each represents a hydrogen atom, an alkyl group or an aryl group;

$D^{11}$ and $D^{12}$ may be bonded to each other to form a ring; and $D^8$ and $D^{11}$ and/or $D^9$ and $D^{12}$ may also be bonded to each other to form a ring;

X, Y and Z each represents $=C(D^{13})-$ or a nitrogen atom; $D^{13}$ represents a hydrogen atom, an alkyl group, an aryl group, an alkoxy group, an aryloxy group or an amino group; when X and Y are $=C(D^{13})-$ or when Y and Z are $=C(D^{13})-$, then two $D^{13}$'s may be bonded to each other to form a saturated or unsaturated carbon ring.

In the formula, the groups may further be substituted.

Specific examples of the magenta dyes are mentioned below.

M-1

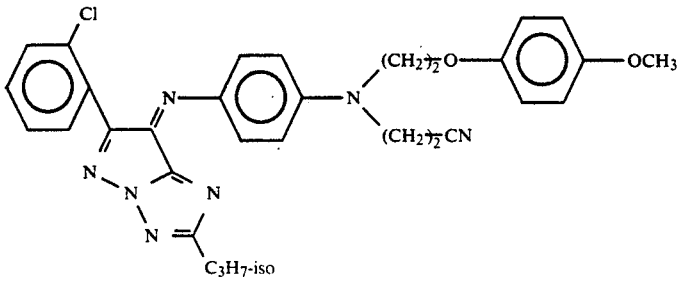

-continued
M-2
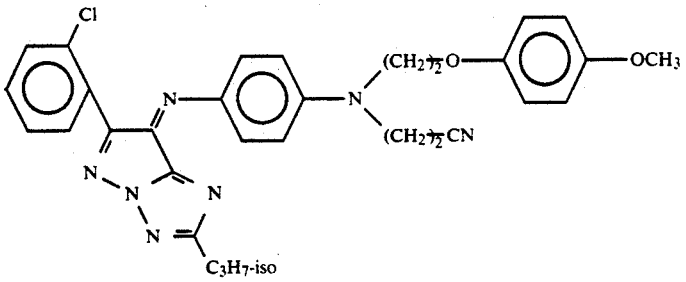
M-3
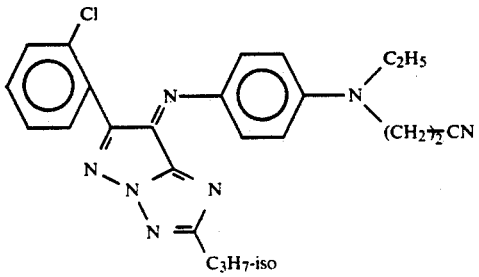
M-4
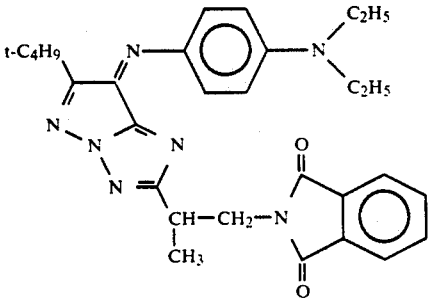
M-5
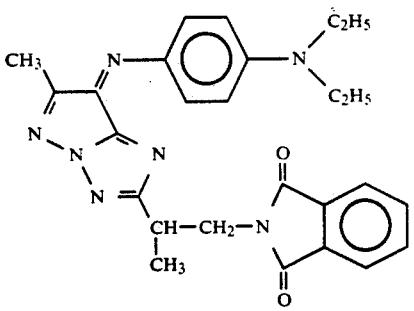
M-6
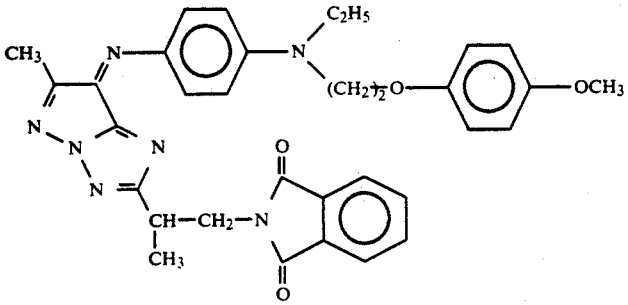

-continued
M-7
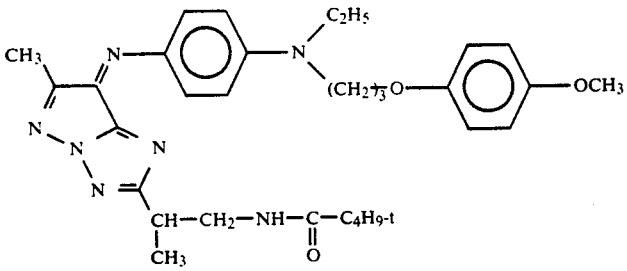
M-8
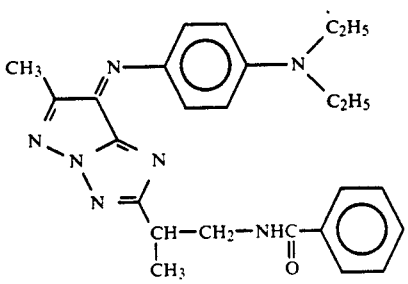
M-9
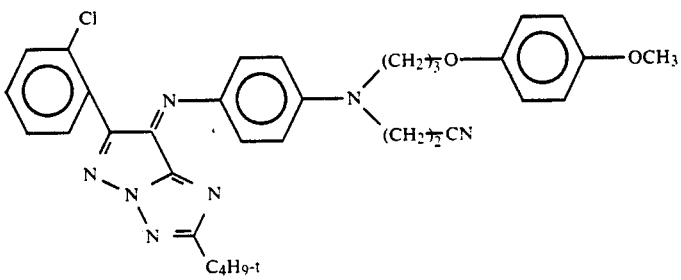
M-10
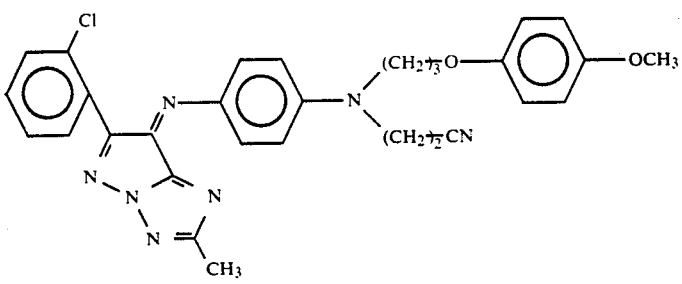
M-11
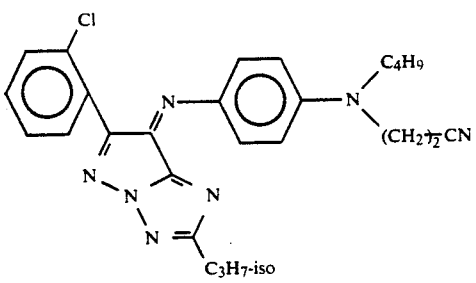
As cyan dyes for use in the present invention, preferred are those of the following general formula (C):
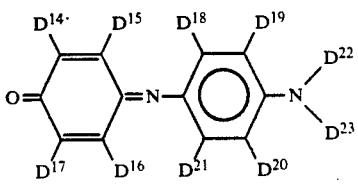
(C)

where $D^{14}$ to $D^{21}$ each has the same meanings as those of $D^{6}$ to $D^{10}$, as defined above; and $D^{22}$ and $D^{23}$ each has the same meanings as those of $D^{11}$ and $D^{12}$, as defined above.
Specific examples of the cyan dyes are mentioned below.
C-1
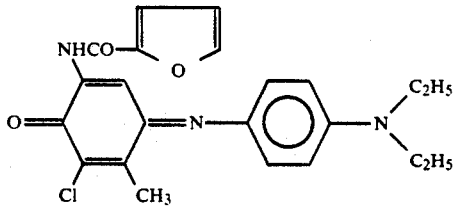
C-2
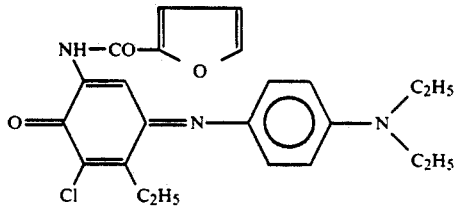
C-3
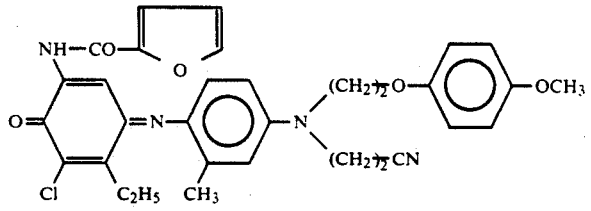
C-4
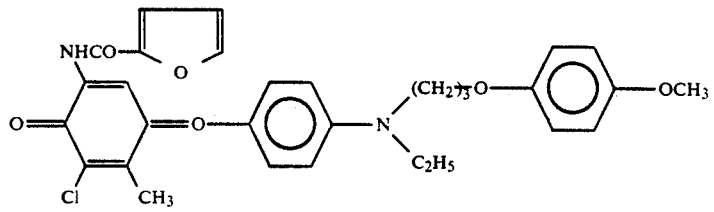
C-5
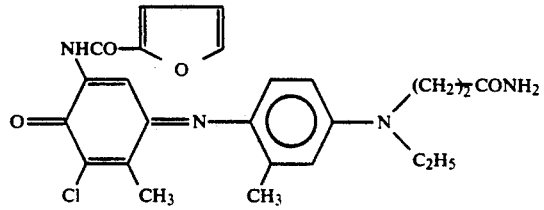
C-6
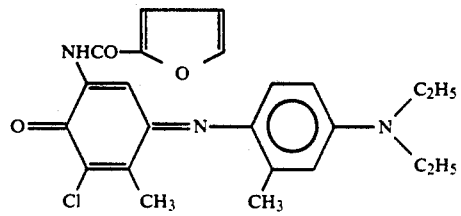

-continued

C-7

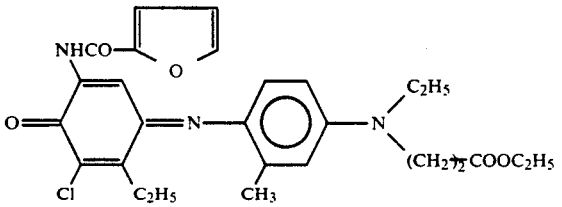

C-8

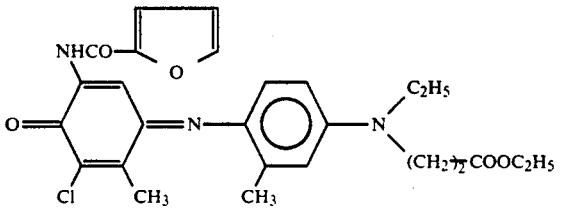

C-9

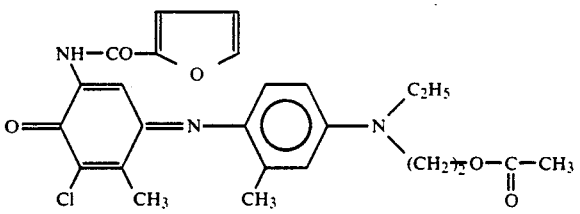

C-10

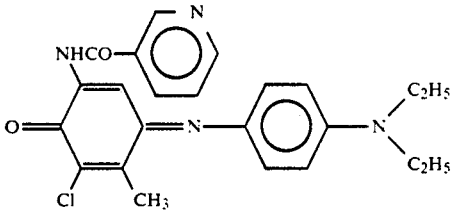

C-11

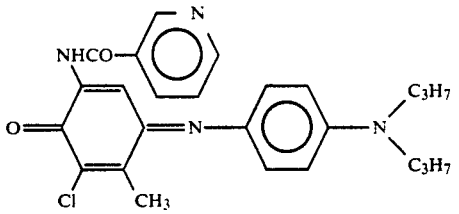

Introduction of anti-fading groups, such as described in Japanese Patent Application No. 1-271078 (corresponding to JP-A-3-205189), into compounds of the above-mentioned dye formulae (Y), (M) and (C), is preferred for improving the light fastness of the compounds.

As the binder resin to be used along with the above-mentioned dyes, any known binder resins are usable. In general, those which have a high heat-resistance and which do not interfere with transfer of dyes under heat are selected. For instance, examples of usable binder resins include polyamide resins, polyester resins, epoxy resins, polyurethane resins, polyacrylic resins (for example, polymethyl methacrylate, polyacrylamide, polystyrene-2-acrylonitrile), vinyl resins (for example, polyvinyl pyrrolidone), polyvinyl chloride resins (for example, vinyl chloride-vinyl acetate copolymer), polycarbonate resins, polystyrenes, polyphenylene oxides, cellulose resins (for example, methyl cellulose, ethyl cellulose, carboxymethyl cellulose, cellulose acetate hydrogen phthalate, cellulose acetate, cellulose acetate propionate, cellulose acetate butyrate, cellulose triacetate), polyvinyl alcohol resins (for example, polyvinyl alcohol, and partially saponified polyvinyl alcohols such as polyvinyl butyral), petroleum resins, rosin derivatives, coumarone-indene resins, terpene resins, and polyolefin resins (for example, polyethylene, polypropylene).

The amount of the binder resin to be used is preferably from about 80 to about 600 parts by weight to 100 parts by weight of dye.

An ink solvent, which may be any known one, can be used for dissolving or dispersing the above-mentioned dyes and binder resins, in the present invention.

The dye to be used in the dye-providing layer is suitably selected in order that a desired color hue can be transferred by printing. If desired, two or more dye-providing layers each having a different hue can be formed on a support of one dye-providing element, by putting them side by side thereon. For instance, where a color image such as a color photographic image is formed by repeated printing of plural colors in accordance with a color separating signal, the printed image is desired to have cyan, magenta and yellow color hues. Accordingly, in the case, three dye-providing layers each containing one of the dyes of giving such color hues are put in a desired order on a support. As the case may be, a dye-providing layer of containing a black color hue-giving dye may further be formed on the same support, in addition to three dye-providing layers each containing one of such cyan, magenta and yellow dyes. Where such plural dye providing-layers are formed on a support, it is recommended to provide a position detecting mark along with any of the plural dye-providing layers. By provision of such a mark, any other ink than those for forming the dye-providing layers or any additional printing step may be omitted.

The dye-providing element is desired to be treated for anti-sticking on the surface of the support not having the dye-providing layer, for the purpose of preventing sticking of the element due to the heat of a thermal head when printing is effected from the back surface of the dye-providing element and for the purpose of improving the slide property of the dye-providing element.

For instance, provision of a heat-resistant slip layer is recommended which contains (1) a reaction product of a polyvinyl butyral resin and an isocyanate, (2) an alkali metal or alkaline earth metal salt of a phosphate and (3) a filler. As the polyvinyl butyral resin to be used, preferred is one having a molecular weight of approximately from 60,000 to 200,000 and a glass transition point of from 80° to 110° C. and having a vinyl butyral moiety content of from 15 to 40% by weight from the viewpoint of having many reaction sites reactive to isocyanates. As an alkali metal or alkaline earth metal salt of a phosphate, use can be made, for example, of Gafac RD720 (product by Toho Chemical Co.). The amount of alkali metal or alkaline earth metal salt of a phosphate may be from 1 to 50% by weight, preferably from 10 to 40% by weight based on the weight of the polyvinyl butyral resin.

The heat-resistant slip layer is desired to have sufficient heat resistance. Therefore it may be provided by coating a composition comprising a thermosetting synthetic resin and a hardening agent, for example, a combination of a polyvinyl butyral and a polyhydric isocyanate, an acryl polyol and a polyhydric isocyanate, a cellulose acetate and a titanium chelating agent, or a polyester and an organic titanium compound.

As a material for the support constituting the thermal transfer image-receiving element for use in the present invention, any material which is durable and resistant to the transferring temperature and which satisfies all the necessary conditions of smoothness, whiteness, slidability, friction property, antistatic property and depression after transfer, may be used. For instance, suitable examples include paper supports such as synthetic paper (e.g., polyolefin synthetic paper, polystyrene synthetic paper), high-grade paper, art paper, coated paper, cast-coated paper, wall paper, lining paper, synthetic resin- or emulsion-impregnated paper, synthetic rubber latex-impregnated paper, synthetic resin-incorporated paper, sheet paper, cellulose fiber paper, polyolefin-coated paper (especially, paper as coated polyethylene on both surfaces thereof); various plastic films or sheets of polyolefins, polyvinyl chloride, polyethylene terephthalate, polystyrene methacrylates or polycarbonates, as well as such plastic films or sheets as surface-treated so as to impart white reflectivity thereto; and laminates comprising any of the above-mentioned examples.

The thermal transfer image-receiving element of the present invention has an image-receiving layer. The image-receiving layer is preferably one which contains a substance capable of receiving the thermal transferring dyes as transferred from the thermal transfer dye-providing element during printing and fixing the thus-transferred dyes into the image-receiving layer, singly or along with any another binder substance. The image-receiving layer preferably has a thickness of approximately from 0.5 to 50 μm. As specific examples of substances which may be in such an image-receiving layer for receiving the thermal transferring dyes to be transferred thereto from the thermal transfer dye-providing element, polymers of the following resins are exemplary. The polymers preferably have the molecular weight of from $10^3$ to $10^5$.

(A) Resins having ester bonds

Polyester resins obtained by condensation of a dicarboxylic acid component such as terephthalic acid, isophthalic acid or succinic acid (the dicarboxylic acid component may have a sulfonic acid group, a carboxyl group or the like) and ethylene glycol, diethylene glycol, propylene glycol, neopentyl glycol, bisphenol A or the like; polyacrylate resins or polymethacrylate resins such as polymethyl methacrylate, polybutyl methacrylate, polymethyl acrylate or polybutyl acrylate; polycarbonate resins; polyvinyl acetate resins; styrene-acrylate resins; and vinyltoluene-acrylate resins. Specific examples are described in JP-A-59-101395, JP-A-63-7971, JP-A-63-7972, JP-A-63-7973 and JP-A-60-294862. As commercial products, usable are Vylon 290, Vylon 200, Vylon 280, Vylon 300, Vylon 103, VylonGK-140 and VylonGK-130 (all products by Toyobo Co., Ltd.) and ATR-2009 and ATR-2010 (both products by Kao Corporation).

(B) Resins having urethane bonds

Polyurethane resins.

(C) Resins having amido bonds

Polyamide resins.

(D) Resins having urea bonds

Urea resins.

(E) Resins having sulfone bonds

Polysulfone resins.

(F) Other resins having high polar bonds

Polycaprolactone resins, styrene-maleic anhydride resins, polyvinyl chloride resins, and polyacrylonitrile resins.

In addition to the above-mentioned resins, mixtures of them, as well as copolymers of them, may also be used.

The thermal transfer image-receiving element may contain, especially in the image-receiving layer, a high boiling point organic solvent or a thermal solvent as a substance capable of accepting the thermal transferring dye as transferred from the thermal transfer dye-providing element of the resent invention or as a promoter for diffusion of the dye.

As examples of such a high boiling organic solvent and a thermal solvent to be used for the purpose, compounds described in JP-A-62-174754, JP-A-62-245253, JP-A-61-209444, JP-A-61-200538, JP-A-62-8145, JP-A-62-9348, JP-A-62-30247, and JP-A-62-136646 are mentioned.

The image-receiving layer of the thermal transfer image-receiving element may have the substance capable of accepting the transferred thermal transferring dye in the form of a dispersion as dispersed in a water-soluble binder. As such a water-soluble binder in the case, any known various water-soluble polymers can be used. Preferred are water-soluble polymers having groups capable of being crosslinked with a hardening agent. Gelatins are especially preferred.

The image-receiving layer may be composed of two or more (plural) layers. In the case of plural layers, it is desired that the layer nearer to the support is made of a synthetic resin having a lower glass transition point or contains a high boiling point organic solvent or a thermal solvent for the purpose of elevating the fixability of the transferred dye in the layer. On the other hand, the outermost layer is made of a synthetic resin having a higher glass transition point and contains a minimum amount of a high boiling point organic solvent or a thermal solvent or contains neither a high boiling point organic solvent nor a thermal solvent for the purpose of preventing various disorders or accidents such as stickiness of the surface, adhesion of the surface to other substances, re-transfer of the once transferred dye to other substances, and blocking of the surface with the thermal transfer dye-providing element as attached thereto.

The total thickness of the image-receiving layer is desirably within the range of from 0.5 to 50 μm, especially preferably from 3 to 30 μm. Where the image-receiving layer is composed of two layers, the thickness of the outermost layer is preferably within the range of from 0.1 to 2 μm, especially preferably from 0.2 to 1 μm.

The thermal transfer image-receiving element usable in the present invention may have an interlayer between the support and the image-receiving layer.

Such an interlayer may be anyone of a cushion layer, a porous layer or a dye diffusion preventing layer, or a layer having two or more combined functions of such layers depending upon the quality of the material constituting the interlayer. As the case may be, it may also have a role as an adhesive layer.

The dye diffusion preventing layer is one having a function of preventing diffusion of the transferred thermal transferring dye to the support. The binder constituting the dye diffusion preventing layer may be either a water-soluble one or an organic solvent-soluble one. Preferred is a water-soluble binder. As examples of the water-soluble binder for the layer, those mentioned above as examples of the binder for the image receiving layer are referred to. Especially preferred is gelatin.

The porous layer has a function of preventing diffusion of the heat (as imparted to the image-receiving element during thermal transfer process) from the image-receiving layer to the support for the purpose of efficiently utilize the imparted heat.

The image-receiving layer, cushion layer, porous layer, diffusion preventing layer and adhesive layer constituting the thermal transfer image-receiving element for use in the present invention can contain a fine powder of silica, clay, talc, diatomaceous earth, calcium carbonate, calcium sulfate, barium sulfate, aluminium silicate, synthetic zeolite, zinc oxide, lithopone, titanium oxide, alumina or the like.

The thermal transfer image-receiving element of the present invention may contain a brightening agent. As examples of usable brightening agents, there are mentioned compounds described in K. Veenkataraman, *The Chemistry of Synthetic Dyes*, Vol. 5, Chap. 8, and JP-A-61-143752. More precisely, there are mentioned stilbene compounds, coumarin compounds, biphenyl compounds, benzoxazolyl compounds, naphthalimide compounds, pyrazoline compounds, carbostyryl compounds, and 2,5-dibenzoxazolethiophene compounds.

Such a brightening agent may be incorporated into the image-receiving element along with an anti-fading agent.

The layers constituting the thermal transfer dye providing element and the thermal transfer image-receiving element of the present invention may be hardened with a hardening agent.

Where organic solvent-soluble polymers are hardened, hardening agents such as described in JP-A-61-199997 and JP-A-58-215398 may be used. To polyester resins, application of isocyanate hardening agents is especially preferred.

On the other hand, for hardening water-soluble polymers, hardening agents such as described in U.S. Pat. No. 4,678,739 (column 41), and JP-A-59-116655, JP-A-62-245261 and JP-A-61-18942 are suitable. More precisely, there are mentioned aldehyde hardening agents (e.g., formaldehyde), aziridine hardening agents, epoxy hardening agents, vinylsulfone hardening agents (e.g., N,N'-ethylene-bis(vinylsulfonylacetamido)ethane), N-methylol hardening agents (e.g., dimethylol urea), as well as high polymer hardening agents (e.g., compounds described in JP-A-62-234157).

The thermal transfer dye-providing element and the thermal transfer image-receiving element of the present invention may contain an anti-fading agent. Such an antifading agent includes, for example, an antioxidant, an ultraviolet absorbent, as well as known metal complexes for this purpose.

As examples of antioxidants, there are mentioned chroman compounds, coumaran compounds, phenol compounds (e.g., hindered phenols), hydroquinone derivatives, hindered amine derivatives, and spiroindane compounds. Additionally, compounds described in JP-A-61-159644 are also effectively used.

As examples of usable ultraviolet absorbents, there are mentioned benzotriazole compounds (such as those described in U.S. Pat. No. 3,533,794), 4-thiazolidone compounds (such as those described in U.S. Pat. No. 3,352,681), benzophenone compounds (such as those described in JP-A-56-2784), and other compounds as described in JP-A-54-48535, JP-A-62-136641 and JP-A-61-88256. Additionally, ultraviolet absorbing polymers described in JP-A-62-260152 are also effective.

As examples of usable metal complexes, there are mentioned compounds as described in U.S. Pat. Nos. 4,241,155, 4,245,018 (columns 3 to 36) and 4,254,195 (columns 3 to 8), JP-A-62-174741, JP-A-61-88256 (pages 27 to 29), JP-A-1-75568 and JP-A-63-199248.

Specific examples of anti-fading agents usable in the present invention are described in JP-A-62-215272 (pages 125 to 137).

The anti-fading agent has a function of preventing the transferred dyes from fading and may be previously added to the image-receiving element or, alternatively, it may be supplied later to the element from an external source, for example, by transferring it from the dye-providing element as attached to the image-receiving element.

The above-mentioned antioxidant, ultraviolet absorbent and metal complex can be used in any combination thereof.

The layers constituting the thermal transfer dye-providing element and those constituting the thermal transfer image-receiving element of the present invention may contain various surfactants as a coating aid as well as for the purpose of improving the releasability, improving the slide property, preventing static charges and accelerating the developability.

For instance, usable for these purposes are nonionic surfactants, anionic surfactants, amphoteric surfactants and cationic surfactants. Specific examples of them are described in JP-A-62-173463 and JP-A-62-183457.

Where a substance of accepting thermal transferring dyes, a releasing agent, an anti-fading agent, an ultraviolet absorbent, a brightening agent and other hydrophobic compounds are dispersed in a water-soluble binder, it is recommended to use a surfactant as a dispersion aid. For this purpose, the above-mentioned surfactants as well as surfactants as described in JP-A-59-157636 (pages 37 to 38) are especially preferably employed.

The thermal transfer dye-providing element and the thermal transfer image-receiving element of the present invention may contain a matting agent. As examples of usable matting agents, there are mentioned compounds described in JP-A-61-88256 (page 29) such as silicon dioxide, polyolefins or polymethacrylates, as well as compounds described in JP-A-63-274944 and JP-A-63-274952 such as benzoguanamine resin beads, polycarbonate resin beads and AS resin beads.

As mentioned above, the thermal transfer dye-providing element of the present invention is used for forming transferred images. The process of forming a transferred image from the element of the present invention comprises heating the dye-providing element, preferably from the back surface of the dye-providing element, with a thermal head or lasers in accordance with the color image to be transferred, as mentioned above, to thereby transfer it to the image-receiving element to form a transferred image thereon.

The dye-providing element of the present invention is in the form of a sheet or an endless roll or ribbon. Where it is in the form of an endless roll or ribbon, it contains only one kind of a thermal transferring dye or contains separate ranges of different thermal transferring dyes of cyan and/or magenta and/or yellow and/or black and others.

The present invention includes monochromatic, dichromatic, tri-chromatic or tetra-chromatic or more polychromatic materials.

As one preferred embodiment of the present invention, the dye-providing element has a cyan dye, a magenta dye and an yellow dye separately, in successive and repeated ranges, coated on a polyethylene terephthalate support. Using this element, the above-mentioned heating step is carried out successively for the respective dyes to finally form a tri-chromatic transferred image. As a matter of course, where the heating step is carried out for a monochromatic color, a monochromatic image is obtained. As lasers to be used for thermal transferring dyes from the dye-providing element to the image-receiving element in the present invention, there are mentioned argon, krypton or the like ion gas lasers: copper, gold, cadmium or the like metal vapor lasers; ruby, YAG or the like solid lasers; as well as gallium-arsenic or the like semiconductor lasers capable of emitting infrared rays of from 750 to 870 nm. For practical use, semiconductor lasers are preferred in view of the small-sized equipment, low-cost, stability, liability, durability and easiness of modulation.

The above-mentioned dye-providing element and image-receiving element contain, in at least either or both surfaces of the dye-providing layer and the dye-receiving layer, at least one compound of the above-mentioned formula (1). Of course, the formula (1) compound can be blended throughout the dye-providing and/or dye-receiving layer compositions, or surface-coated thereon.

Examples of especially preferred compounds of formula (1) for use in the present invention, either singly or in combination, are those of the following formulae (3) to (8).

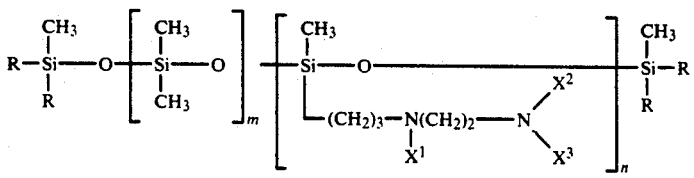

(3)

where m is an integer of from 5 to 100; n is an integer of from 1 to 10; R is $CH_3$ or $OCH_3$; $X^1$ is H or a carbonyl-containing substituent; $X^2$ is H; and $X^3$ is a carbonyl-containing substituent or a $—SO_2—$containing substituent.

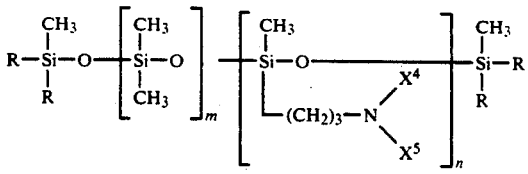

(4)

where m is an integer of from 5 to 100; n is an integer of from 1 to 10; R is $CH_3$ or $OCH_3$; $X^4$ is H, $CH_3$ or $C_2H_5$; and $X^5$ is $CH_3$, $C_2H_5$, a carbonyl-containing substituent or a $—SO_2—$containing substituent.

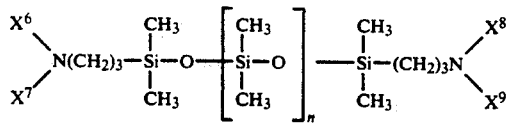

(5)

where n is an integer of from 10 to 100; and $X^6$, $X^7$, $X^8$ and $X^9$ each is H, $CH_3$, $C_2H_5$, a carbonyl-containing substituent or a $—SO_2—$containing substituent.

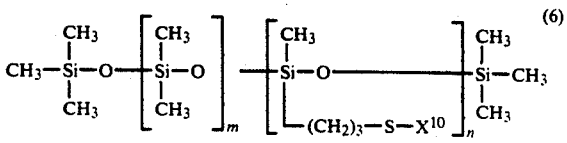

(6)

where m is an integer of from 5 to 100; n is an integer of from 1 to 10; and $X^{10}$ is $CH_3$, $C_2H_5$, $C_3H_7$ or a carbonyl-containing substituent.

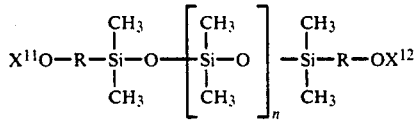

(7)

n is an integer of from 5 to 100; R is a divalent linking group; and $X^{11}$ and $X^{12}$ each is a carbonyl-containing substituent.

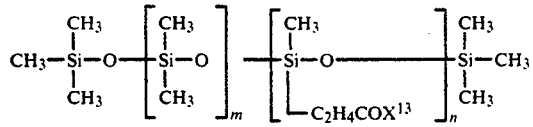

(8)

where m is an integer of from 10 to 150; n is an integer of from 1 to 10; and $X^{13}$ is a —NH—containing substituent or a O-containing substituent.

Specific examples of these compounds are mentioned below.

TABLE 1

| Compound No. | $X^1$ | $X^2$ | $X^3$ | R | m | n |
|---|---|---|---|---|---|---|
| 1 | $-CO-C_6H_5$ | H | $-CO-C_6H_5$ | $CH_3$ | 37 | 2 |
| 2 | H | H | " | $CH_3$ | 38 | 2 |
| 3 | $-COCH_3$ | H | $-COCH_3$ | $CH_3$ | 38 | 2 |
| 4 | H | H | " | $CH_3O$ | 32 | 3 |
| 5 | $-COC_2H_5$ | H | $-COC_2H_5$ | $CH_3$ | 37 | 4 |
| 6 | $-COC_3H_7$-iso | H | $-COC_3H_7$-iso | $CH_3$ | 30 | 1 |
| 7 | $-COC_3F_7$ | H | $-COC_3H_7$ | $CH_3$ | 20 | 1 |
| 8 | H | H | $-COC_4H_9$-t | $CH_3$ | 60 | 4 |
| 9 | $-COCF_7$ | H | $-COC_3F_7$ | $CH_3O$ | 62 | 2 |
| 10 | $-COC_3F_7$ | H | $-COCF_3$ | $CH_3$ | 38 | 2 |
| 11 | H | H | $-COCH_2-O-C_6H_5$ | $CH_3$ | 22 | 1 |
| 12 | $-COC_7H_{15}$ | H | $-COC_7H_{15}$ | $CH_3$ | 22 | 1 |
| 13 | $-COCH_3$ | H | $-COC_6H_5$ | $CH_3$ | 37 | 2 |
| 14 | $-COCH_2CH_2Cl$ | H | $-COCH_2CH_2Cl$ | $CH_3$ | 80 | 3 |
| 15 | 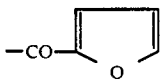 | H | 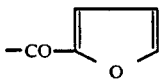 | $CH_3$ | 46 | 2 |
| 16 | $-CO-C_6H_4CH_3$(p) | H | $-CO-C_6H_4CH_3$(p) | $CH_3$ | 36 | 2 |
| 17 | $-CO-C_6H_4OCH_3$(p) | H | $-CO-C_6H_4OCH_3$(p) | $CH_3$ | 23 | 1 |
| 18 | H | H | 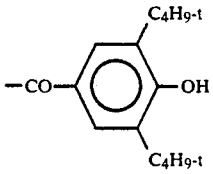 | $CH_3$ | 37 | 2 |
| 19 | 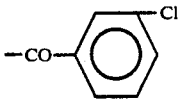 | H | 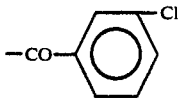 | $CH_3$ | 25 | 1 |
| 20 | 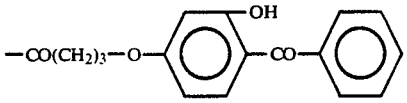 | H | 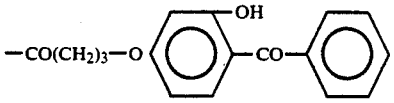 | $CH_3$ | 37 | 2 |
| 21 | H | H | " | | | |
| 22 | 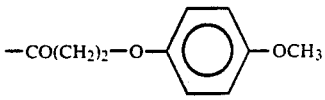 | H | 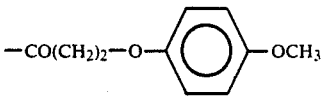 | $CH_3$ | 37 | 2 |

TABLE 1-continued

| Compound No. | $X^1$ | $X^2$ | $X^3$ | R | m | n |
|---|---|---|---|---|---|---|
| 23 | H | H | 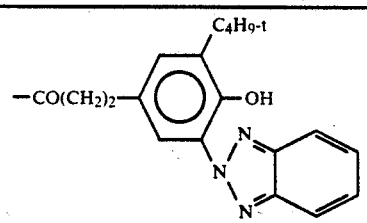 | $CH_3$<br>$CH_3O$ | 38<br>25 | 2<br>1 |
| 24 | H | H | 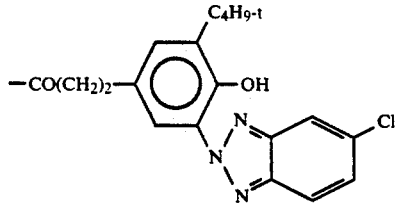 | $CH_3O$ | 40 | 2 |
| 25 | H | H | 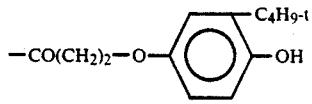 | $CH_3$ | 55 | 3 |
| 26 | H | H | 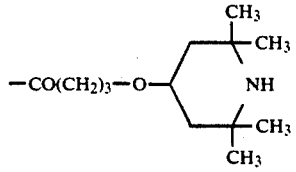 | $CH_3$ | 30 | 2 |
| 27 | 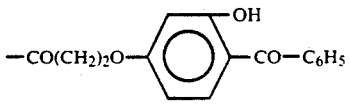 | H | 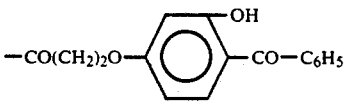 | $CH_3$ | 37 | 2 |
| 28 | $-COOCH_3$ | H | $-COOCH_3$ | $CH_3$ | 37 | 4 |
| 29 | H | H | $-COOCH_3$ | $CH_3$ | 20 | 1 |
| 30 | $-COOC_2H_5$ | H | $-COOC_2H_5$ | $CH_3$ | 22 | 1 |
| 31 | H | H | $-COO-C_6H_5$ | $CH_3$ | 38 | 2 |
| 32 | $-CONHCH_3$ | H | $-CONHCH_3$ | $CH_3$ | 38 | 2 |
| 33 | H | H | $-CON(C_2H_5)_2$ | $CH_3$ | 37 | 2 |
| 34 | $-SO_2CH_3$ | H | $-SO_2CH_3$ | $CH_3$ | 37 | 2 |
| 35 | H | H | $-SO_2-C_6H_5$ | $CH_3$ | 37 | 2 |
| 36 | H | H | $-CO-C_6H_{11}$ | $CH_3$ | 25 | 1 |
| 37 | $CH_3$ | $CH_3$ | $CH_3$ | $CH_3$ | 21 | 1 |
| 38 | $C_2H_5$ | $C_2H$ | $C_2H_5$ | $CH_3$ | 20 | 1 |

TABLE 2

| Compound No. | $X^4$ | $X^5$ | R | m | n |
|---|---|---|---|---|---|
| 39 | H | $-CO-C_6H_5$ | $CH_3$ | 40 | 2 |
| 40 | H | $-COCH_3$ | $CH_3$ | 30 | 2 |
| 41 | $CH_3$ | $-COC_2H_5$ | $CH_3$ | 79 | 2 |
| 42 | H | $-COC_3H_7$-iso | $CH_3$ | 38 | 1 |
| 43 | H | $-COC_4H_9$-t | $CH_3$ | 36 | 2 |
| 44 | H | $-COC_3F_7$ | $CH_3O$ | 40 | 2 |
| 45 | H | $-COCF_3$ | $CH_3$ | 40 | 2 |
| 46 | H | 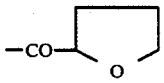 | $CH_3$ | 80 | 1 |
| 47 | H | $-CO-C_6H_4OCH_3$(p) | $CH_3$ | 45 | 2 |
| 48 | H | $-CO-C_6H_4-CH_3$(m) | $CH_3$ | 40 | 1 |
| 49 | H | $-COC_7H_{15}$ | $CH_3$ | 40 | 1 |

TABLE 2-continued
| Compound No. | $X^4$ | $X^5$ | R | m | n |
|---|---|---|---|---|---|
| | 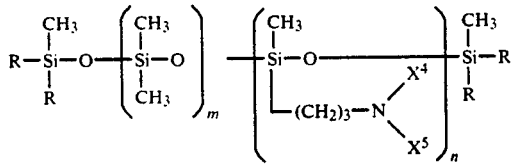 | | | | |
| 50 | H | 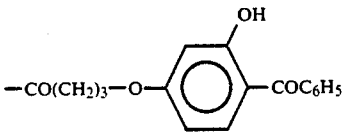 | $CH_3$ | 38 | 2 |
| 51 | H | 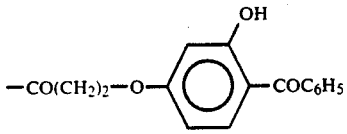 | $CH_3$ | 38 | 2 |
| 52 | H | 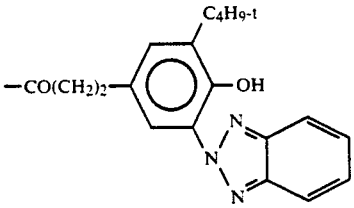 | $CH_3$ | 37 | 1 |
| 53 | H | 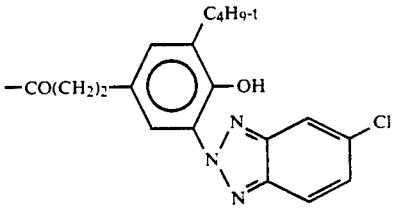 | $CH_3$ | 37 | 2 |
| 54 | H | 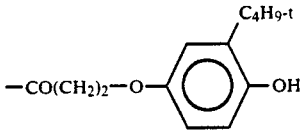 | $CH_3O$ | 40 | 2 |
| 55 | H | 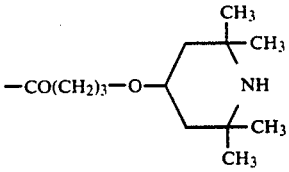 | $CH_3$ | 37 | 2 |
| 56 | H | $-COOC_2H_5$ | $CH_3$ | 37 | 4 |
| 57 | H | $-CONH-C_6H_5$ | $CH_3$ | 38 | 2 |
| 58 | H | $-SO_2CH_3$ | $CH_3$ | 37 | 1 |
| 59 | H | $-SO_2-C_6H_5$ | $CH_3$ | 37 | 1 |
| 60 | $C_2H_5$ | $C_2H_5$ | $CH_3$ | 37 | 2 |
TABLE 3
| Compound No. | $X^6$ | $X^7$ | $X^8$ | $X^9$ | n |
|---|---|---|---|---|---|
| 61 | $-CO-C_6H_5$ | H | $-CO-C_6H_5$ | H | 20 |
| 62 | $-COCH_3$ | H | $-COCH_3$ | H | 30 |
| 63 | $-COC_5H_{11}$ | H | $-COC_5H_{11}$ | H | 30 |
| 64 | $-COC_3F_7$ | H | $-COC_3F_7$ | H | 15 |

TABLE 3-continued
| Compound No. | $X^6$ | $X^7$ | $X^8$ | $X^9$ | n |
|---|---|---|---|---|---|
| 65 | 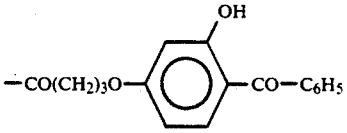 | H | 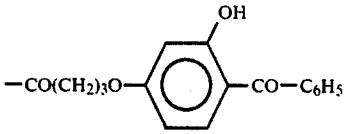 | H | 30 |
| 66 | $C_2H_5$ | $C_2H_5$ | " | H | 41 |
| 67 | 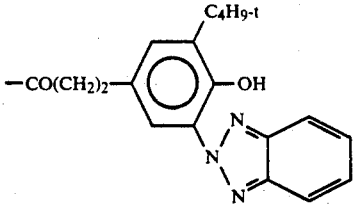 | H | 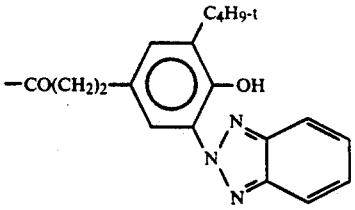 | H | 40 |
| 68 | $-COOC_2H_5$ | H | $-COOC_2H_5$ | H | 37 |
| 69 | $-CON(C_2H_5)_2$ | H | $-CON(C_2H_5)_2$ | H | 15 |
| 70 | $-SO_2CH_3$ | H | $-SO_2CH_3$ | H | 50 |
| 71 | $-SO_2C_6H_5$ | H | $-SO_2C_6H_5$ | H | 60 |
| 72 | $C_2H_5$ | $C_2H_5$ | $C_2H_5$ | $C_2H_5$ | 30 |
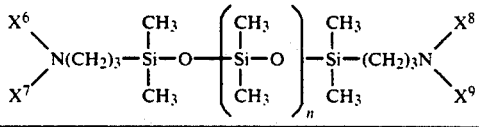
TABLE 4
| Compound No. | $X^{10}$ | m | n |
|---|---|---|---|
| 73 | $-CO-C_6H_5$ | 40 | 2 |
| 74 | $-COCH_3$ | 30 | 2 |
| 75 | 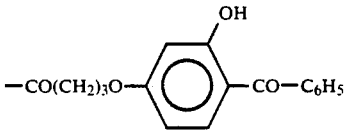 | 50 | 2 |
| 76 | 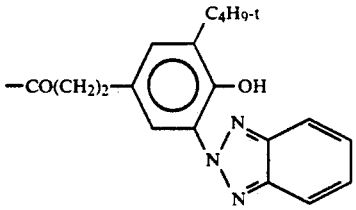 | 35 | 1 |
TABLE 4-continued
| Compound No. | $X^{10}$ | m | n |
|---|---|---|---|
| 77 | $C_3H_7$ | 60 | 2 |
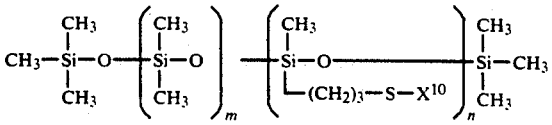
TABLE 5
| Compound No. | $X^{11}$ | $X^{12}$ | $-R-$ | n |
|---|---|---|---|---|
| 78 | $-CO-C_6H_5$ | $-COC_6H_5$ | $-(CH_2)_3-O(CH_2)_2-O-$ | 10 |
| 79 | $-COCH_3$ | $-COCH_3$ | " | 20 |
| 80 | 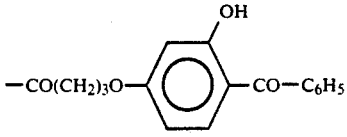 | 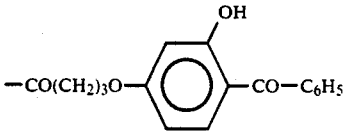 | " | 10 |

TABLE 5-continued

| Compound No. | $X^{11}$ | $X^{12}$ | —R— | n |
|---|---|---|---|---|
| 81 | 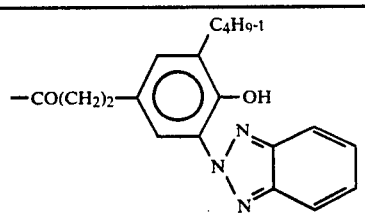 | 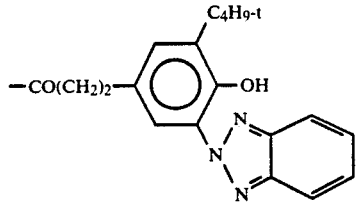 | 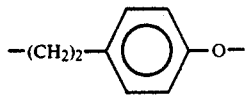 | 15 |

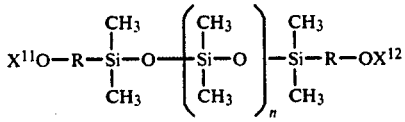

TABLE 6

| Compound No. | $X^{13}$ | m | n |
|---|---|---|---|
| 82 | $-NHC_4H_9$ | 80 | 2 |
| 83 | 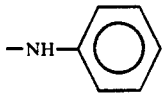 | 70 | 2 |
| 84 | 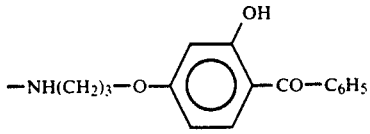 | 70 | 1 |
| 85 | $-OC_2H_5$ | 100 | 2 |
| 86 | 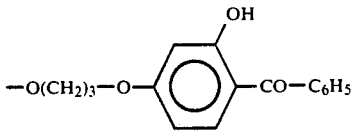 | 50 | 2 |

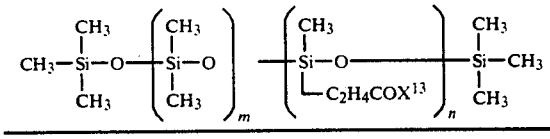

The present invention will be explained in more detail by way of the following examples, which, however, are not intended to restrict the scope of the present invention.

EXAMPLE 1

Formation of Dye-Providing Element Sample (1)

A heat-resistant slip layer was provided on one surface of a 6 μm-thick polyethylene terephthalate film, and a dye-providing layer-coating ink (1) having the composition mentioned below was formed on the other surface in a dry amount of 0.4 g/m². Thus, a dye-providing element sample (1) was prepared.

| Composition of Dye-Providing Layer-Coating Ink (1): | |
|---|---|
| Dye (Y-10) | 3 g |

-continued

| Composition of Dye-Providing Layer-Coating Ink (1): | |
|---|---|
| Binder Resin, a polyvinyl butyral (Denkabutyral 5000A, product by Denki Kagaku Kogyo KK) | 2.5 g |
| Hardening Agent, a polyisocyanate (Takenate D110N, product by Takeda Chemical Industries, Ltd.) | 0.2 g |
| Compound 1 (formula (1) compound) | 0.05 g |
| Methyl Ethyl Ketone | 70 ml |
| Toluene | 30 ml |

Formation of Thermal Transfer Image-Receiving Element Sample (1)

A 150 μm-thick synthetic paper (YUPO-FPG-150, product by Oji Yuka Goseishi Co., Ltd.) was used as a support. The following composition (1) for forming a thermal transfer image-receiving layer was coated on one surface of the support by wire bar-coating in a dry thickness of 8 μm. Accordingly, a thermal transfer image-receiving element sample (1) was prepared. Drying of the coated layer was effected first with a drier for pre-drying and then in an oven having a temperature of 50° C. for 15 hours.

| Thermal Transfer Image Receiving Layer-Coating Composition (1): | |
|---|---|
| Polyester Resin (Vylon 200, product by Toyobo Co., Ltd.) | 25 g |
| Hardening Agent (Polyisocyanate KP-90, product by Dainippon Ink And Chemicals, Inc.) | 4 g |
| Compound 48 (formula (1) compound) | 0.5 g |
| Methyl Ethyl Ketone | 85 cc |
| Toluene | 85 cc |

The thermal transfer dye-providing element sample and the thermal transfer image-receiving element sample thus-prepared as mentioned above were attached to each other, with the dye-providing layer facing the image-receiving layer, and a thermal head was applied to the side of the support of the dye-providing element for effecting thermal transfer printing. As the printing condition, the output power of the thermal head was 0.27 W/dot, the pulse width was from 0.1 to 10 msec, the dot density was 6 dots/mm and the pressure was 3 kg/80 mm. Accordingly, an image was recorded on the image-receiving layer of the image-receiving element. After the transfer recording process, the dye-providing element and the image-receiving element were separated from each other, whereupon neither thermal fusion (the dye-providing layer peeled off with portions fused to the image-receiving element) nor static charging to cause adhesion of dust to the formed image occurred. Even after the image-receiving elements were stacked up, after transfer printing, they did not adhere to each other.

COMPARATIVE EXAMPLE 1

An ink (a) having the same composition as that of the dye-providing layer-coating ink (1) of Example 1 was prepared, except that the former did not contain the compound 1. Using the ink (a), a dye-providing element sample (a) was prepared in the same manner as in Example 1. A coating liquid (a') having the same composition as that of the dye-receiving layer-coating liquid (1) of Example 1 was prepared, except that the former did not contain the compound 48. Using the coating liquid (a'), a dye-receiving element sample (a') was prepared in the same manner as in Example 1. Using sample (a) and sample (a') in combinations with each other and with the dye providing and dye receiving element samples of Example 1, thermal transfer recording was then effected in the same manner as in Example 1. For instance, a dye-providing element sample (a) was stacked on each of a dye-receiving element sample (a') and another on a dye-receiving element sample (1), and so on. As a result, where either the dye-providing element or the dye-receiving element contained the formula (1) compound of the present invention, no thermal fusion occurred after thermal printing. However, where both elements did not contain a formula (1) compound, thermal fusion occurred.

EXAMPLE 2

Formation of Dye-Providing Element Sample (2)

A dye-providing layer-coating ink having the following composition was coated over the same 6 μ-thick PET film as that used in Example 1, to form a dye-providing element sample (2) in the same manner as in Example 1.

| Composition of Dye-Providing Layer-Coating Ink (2): | |
|---|---|
| Dye (M-5) | 4 g |
| Binder Resin, a polyvinyl butyral (Denkabutyral 5000A) | 3 g |
| Hardening Agent, a polyisocyanate (Takenate D110N) | 0.15 g |
| Compound 67 (formula (1) compound) | 0.05 g |
| Matting Agent (Flowbeads CL-2080, product by Sumitomo Seika Co.) | 0.05 g |
| Methyl Ethyl Ketone | 65 ml |
| Toluene | 35 ml |

Formation of Image-Receiving Element Sample (2)

A 25 μm-thick polyethylene was laminated on both surfaces of a 140 μm-thick paper to form a resin-coated paper. A dye-receiving layer-coating liquid (2) having the composition mentioned below was coated on the resin-coated paper in the same manner as in Example 1 to form an image-receiving element sample (2).

| Dye Receiving Layer-Coating Composition (2): | |
|---|---|
| Polyester Resin (TP220, product by Nippon Synthetic Chemical Co.) | 25 g |
| Compound 77 (formula (1) compound) | 0.8 g |
| Hardening Agent (Polyisocyanate KP-90) | 4 g |
| Matting Agent (Flowbeads CL-2080) | 0.5 g |
| Methyl Ethyl Ketone | 100 cc |
| Toluene | 100 cc |

Using the above-mentioned dye-providing element sample (2) and the image-receiving element sample (2), thermal transfer recording was effected in the same manner as in Example 1. Neither thermal fusion nor static charging occurred, when the elements were peeled off from each other after thermal recording. Also, no dust adhered to the image formed.

COMPARATIVE EXAMPLE 2

A dye-providing element sample (b) and an image-receiving element sample (b') were prepared in the same manner as in Example 2, except that the dye-providing layer-coating ink did not contain compound 67 and the dye-receiving layer-coating composition did not contain compound 77.

These elements were variously mixed and combined with the Example 2 elements in the same manner as in Example 1 and subjected to thermal transfer recording. When the elements were peeled off from each other after thermal recording, no thermal fusion occurred in the cases where at least one of the elements contained the formula (1) compound of the present invention, but thermal fusion occurred in the other cases where both of the elements did not contain a formula (1) compound.

COMPARATIVE EXAMPLE 3

A dye-providing layer-coating ink (3) was prepared in the same manner as in Example 1, except that the compound 1 was replaced by an amino-modified silicone oil (KF-857). Using the ink (3), a dye-providing element sample (3) was prepared in the same manner as in Example 1.

The sample (3) was combined with the image-receiving element sample (b') of Comparative Example 2 and subjected to thermal transfer recording in the same manner as in Example 1. However, thermal fusion occurred between the elements after thermal recording.

EXAMPLE 3

The same test as that in Example 1 was carried out, in which the compound 1 in the dye-providing layer-coating ink (1) was replaced by the formula (1) compound shown in column (A) of Table 9 below and the compound 48 in the dye-receiving layer-coating composition (1) was replaced by the formula (1) compound shown in column (B) of Table 9. The results obtained are shown in Table 9, from which it is understood that the compounds of the present invention are effective for preventing thermal fusion during thermal transfer recording.

TABLE 9

| Test No. | A | B | Result |
|---|---|---|---|
| 1 | 3 | 3 | No thermal fusion |
| 2 | 3 | — | No thermal fusion |
| 3 | — | 3 | No thermal fusion |
| 4 | 3 | 4 | No thermal fusion |
| 5 | 15 | 16 | No thermal fusion |

TABLE 9-continued

| Test No. | A | B | Result |
|---|---|---|---|
| 6 | 22 | 2 | No thermal fusion |
| 7 | 27 | 28 | No thermal fusion |
| 8 | 39 | — | No thermal fusion |
| 9 | 43 | 43 | No thermal fusion |
| 10 | 1 | 46 | No thermal fusion |
| 11 | 54 | 1 | No thermal fusion |
| 12 | 61 | 62 | No thermal fusion |
| 13 | 62 | 61 | No thermal fusion |
| 14 | 78 | 79 | No thermal fusion |
| 15 | 1 | 82 | No thermal fusion |
| 16 | 82 | 82 | No thermal fusion |
| 17 | 83 | 85 | No thermal fusion |
| 18 | 1 | 85 | No thermal fusion |
| 19 | 3 | 82 | No thermal fusion |
| 20 | 85 | 1 | No thermal fusion |

"—" means no formula (1) compound added.

In accordance with the present invention as explained in detail hereinabove, there is provided a thermal transfer recording material composed of a dye-providing element and a dye-receiving element, the surface(s) of either or both of which elements contain(s) at least one compound of formula (1). Using the material, thermal transfer recording may be attained with no bad influences of thermal fusion and static charging.

While the invention has been described in detail and with reference to specific embodiments thereof, it will be apparent to one skilled in the art that various changes and modifications can be made therein without departing from the spirit and scope thereof.

What is claimed is:

1. A thermal transfer recording material comprising a dye-providing element comprising a support having thereon a dye-providing layer containing a thermal transferring dye and a binder resin, and an image-receiving element comprising a support having thereon a dye-receiving layer containing a dye-receiving polymer compound, the dye-providing layer and the dye-receiving layer being kept in contact with each other and heatable in accordance with image signals so as to transfer the dye from the dye-providing layer to the dye-receiving layer to attain recording, wherein at least one of the dye-providing layer and the dye-receiving layer contains at least one polysiloxane compound of formula (1):

I

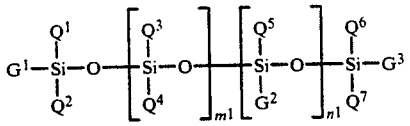

where $Q^1$ to $Q^7$ each represents an alkyl group, an alkoxy group or an aryl group;

$G^1$ to $G^3$ each represents $—Y^1—Y^2$, $—Y^3—N—R—Y^4—N(R^0)—Y^5$, an alkyl group, an aryl group or an alkoxy group;

$Y^1$ represents an alkylene group, an arylene group or an aralkylene group;

$Y^2$ represents $—Z^1—Z^2$ or $—CO—Z^3$;

$Z^1$ represents $—NR^x—$ (where $R^x$ is a hydrogen atom or an alkyl group), —S— or —O—;

$Z^2$ represents $—CO—R^1$, $—CS—R^2$, $—SO_2—R^3$, or $—CR^4(R^5)R^6$;

$Z^3$ represents $—NR^7(R^8)$, $—OR^9$ or $—SR^{10}$;

$Y^3$ and $Y^4$ each has the same meaning as $Y^1$;

$Y^5$ has the same meaning as $Z^2$;

$R^0$ represents a hydrogen atom or an alkyl group:

R represents a hydrogen atom, an alkyl group or $Y^5$;

$R^1$, $R^2$ and $R^3$ each represents an alkyl group, an aryl group, an alkoxy group, an aryloxy group, an alkylamino group or an arylamino group;

$R^4$, $R^5$, $R^6$, $R^7$ and $R^8$ each represents a hydrogen atom, an alkyl group or an aryl group;

$R^9$ and $R^{10}$ each represents an alkyl group or an aryl group;

provided that at least one of $G^1$, $G^2$ and $G^3$ must be $—Y^1—Y^2$ or $—Y^3—NR—Y^4—N(R^0)—Y^5$; and $m^1$ represents an integer of from 0 to 1000, and $n^1$ represents an integer of from 1 to 1000.

2. The thermal transfer recording material as in claim 1, wherein the polysiloxane compound of formula (1) is represented by formula (2):

(2)

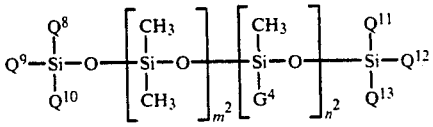

where $Q^8$ to $Q^{13}$ each represents a methyl group or a methoxy group;

$G^4$ represents $—Y^6—NH—CO—R^{11}$ or $—Y^7—N(R^{12})—Y^8—CO—R^{13}$;

$Y^6$, $Y^7$ and $Y^8$ each represents an alkylene group;

$R^{11}$ and $R^{13}$ each has the same meaning as $R^1$;

$R^{12}$ represents a hydrogen atom or $—COR^{14}$;

$R^{14}$ has the same meaning as $R^{11}$; and $m^2$ represents an integer of from 10 to 100, and $n^2$ represents an integer of from 1 to 100.

3. The thermal transfer recording material as in claim 1, wherein the polysiloxane compound of formula (1) is selected from formulae (3) to (8):

(3)

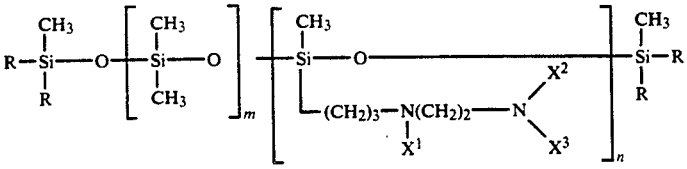

where m is an integer of from 5 to 100; n is an integer of from 1 to 10; R is $CH_3$ or $OCH_3$; $X^1$ is H or a carbonyl-containing substituent; $X^2$ is H; and $X^3$ is a carbonyl-containing substituent or a $—SO_2—$containing substituent;

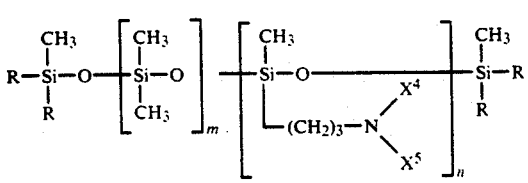

(4)

where m is an integer of from 5 to 100; n is an integer of from 1 to 10; R is $CH_3$ or $OCH_3$; $X^4$ is H, $CH_3$ or $C_2H_5$; and $X^5$ is $CH_3$, $C_2H_5$, a carbonyl-containing substituent or a $—SO_2—$containing substituent;

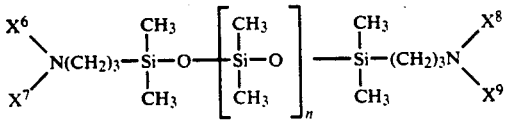

(5)

where n is an integer of from 10 to 100; and $X^6$, $X^7$, $X^8$ and $X^9$ each is H, $CH_3$, $C_2H_5$, or a carbonyl-containing substituent or a $—SO_2—$containing substituent;

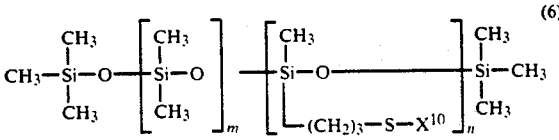

(6)

where m is an integer of from 5 to 100; n is an integer of from 1 to 10; and $X^{10}$ is $CH_3$, $C_2H_5$, $C_3H_7$ or a carbonyl-containing substituent;

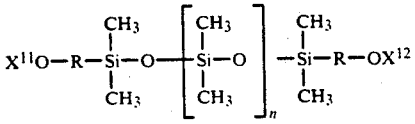

(7)

n is an integer of from 5 to 100; R is a divalent linking group; and $X^{11}$ and $X^{12}$ each is a carbonyl-containing substituent;

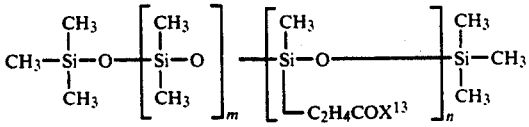

(8)

where m is an integer of from 10 to 150; n is an integer of from 1 to 10; and $X^{13}$ is a —NH—containing substituent or a O-containing substituent.

4. The thermal transfer recording material as in claim 1, wherein said at least one polysiloxane compound of formula (1) is present in at least one of said dye-providing layer and said dye-receiving layer in an amount of from 0.01 to 2 $g/m^2$.

5. The thermal transfer recording material as in claim 4, wherein said at least one polysiloxane compound of formula (1) is present in at least one of said dye-providing layer and said dye-receiving layer in an amount of from 0.01 to 0.5 $g/m^2$.

6. The thermal transfer recording material as in claim 5, wherein said at least one polysiloxane compound of formula (1) is present in at least one of said dye-providing layer and said dye-receiving layer in an amount of from 0.05 to 0.5 $g/m^2$.

7. The thermal transfer recording material as in claim 1, wherein said binder resin is present in an amount of from about 80 to about 600 parts by weight to 100 parts by weight of said thermal transferring dye in said dye-providing layer.

8. The thermal transfer recording material as in claim 1, wherein said dye-providing layer has a dry thickness from about 0.2 to 5 μm.

9. The, thermal transfer recording material as in claim 1, wherein said thermal transferring dye is selected from a yellow dye, a magenta dye or a cyan dye.

10. The thermal transfer recording material as in claim 1, wherein said dye-receiving layer has a thickness of from about 0.5 to 50 μm.

11. The thermal transfer recording material as in claim 1, wherein said dye-receiving polymer compound is selected from the group consisting of a polyester resin, a polyurethane resin, a polyamide resin, a polyurea resin, a polysulfone resin, a polycaprolactone resin, a styrene-maleic anhydride resin, a polyvinyl chloride resin and a polyacrylonitrile resin.

12. The thermal transfer recording material as in claim 1, wherein the dye-receiving polymer compound has a molecular weight of from $10^3$ to $10^5$.

* * * * *